US005174829A

United States Patent [19]

Gray

[11] Patent Number: 5,174,829

[45] Date of Patent: Dec. 29, 1992

[54] REMOVING SURFACE LIQUID FROM ARTICLES

[75] Inventor: Richard H. Gray, Cambridge, United Kingdom

[73] Assignee: H. J. Heinz Company Limited, Hayes, United Kingdom

[21] Appl. No.: 634,192

[22] PCT Filed: May 16, 1990

[86] PCT No.: PCT/GB90/00754

§ 371 Date: Jan. 15, 1991

§ 102(e) Date: Jan. 15, 1991

[87] PCT Pub. No.: WO90/14567

PCT Pub. Date: Nov. 29, 1990

[30] Foreign Application Priority Data

May 17, 1989 [GB] United Kingdom ..... 8911336

[51] Int. Cl.[5] ..... B08B 5/02; B08B 5/04; A47L 5/14

[52] U.S. Cl. ..... 134/21; 15/309.2; 15/345; 134/39

[58] Field of Search ..... 15/306.1, 309.1, 309.2, 15/345, 346; 134/21, 37

[56] References Cited

U.S. PATENT DOCUMENTS

| | | | |
|---|---|---|---|
| 1,575,526 | 3/1926 | Bocher | 15/309.1 X |
| 3,044,098 | 7/1962 | Stalson | 15/309.1 X |
| 3,469,275 | 9/1969 | Deschuttere et al. | 15/345 X |
| 3,546,733 | 12/1970 | Johnson | 15/308 |
| 3,653,425 | 4/1972 | Elliot et al. | 15/308 X |
| 3,736,618 | 6/1973 | Ramsey | 15/309.1 |
| 4,033,785 | 7/1977 | Gibbs | 15/309.1 |
| 4,287,238 | 9/1981 | Stavros | 15/309.1 X |
| 4,477,287 | 10/1984 | Kush et al. | 15/345 X |
| 4,741,113 | 5/1988 | Burdick et al. | 34/92 |

*Primary Examiner*—Chris K. Moore

*Attorney, Agent, or Firm*—St. Onge Steward Johnston & Reens

[57] ABSTRACT

A method and apparatus are provided for removing surface liquid from elongate articles such as cans. After sterilization of filled cans, surface liquid can permit microorganisms to proliferate and risk contamination of the contents. The apparatus comprises means (10) for applying a jet of gas at an acute angle to the surface of the elongate article. means for causing relative motion between the article and the jet, and suction means (12) provided downstream as considered in the direction of the jet, for applying suction to a region of the surface of the elongate article whereby surface liquid is removed therefrom.

11 Claims, 1 Drawing Sheet

REMOVING SURFACE LIQUID FROM ARTICLES

Figure 1:
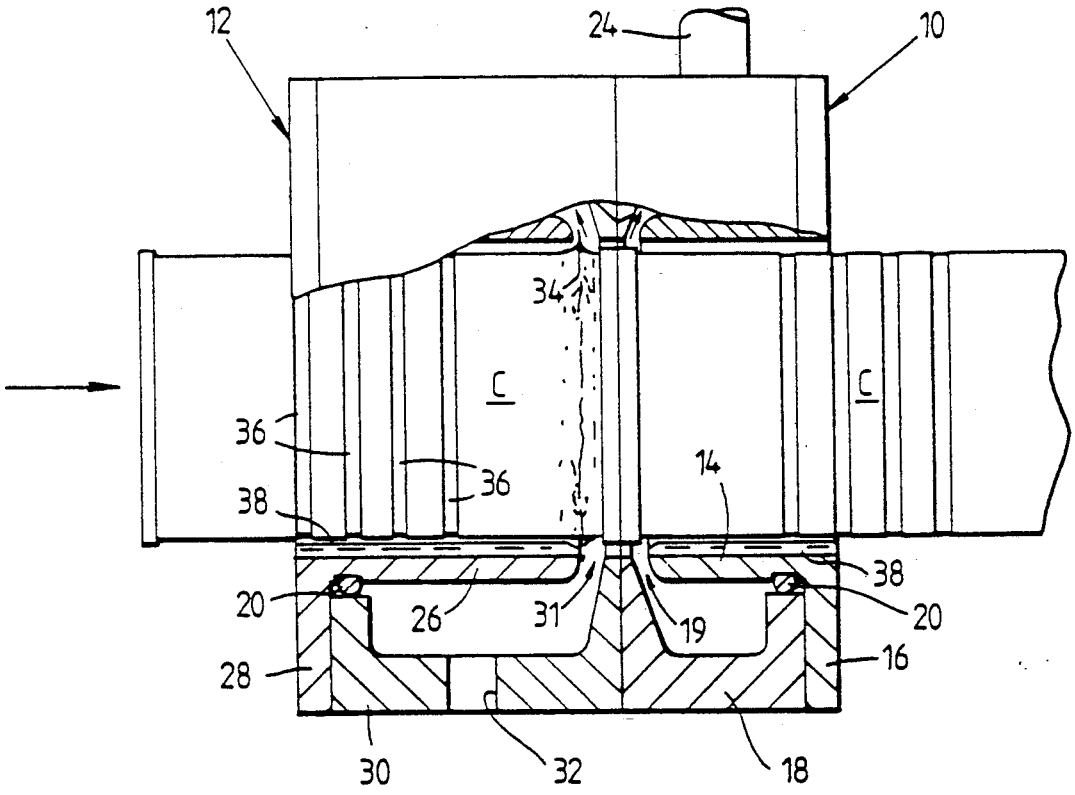

This invention relates to a method and apparatus for removing surface liquid from articles, and more particularly to removing water particles from cylindrical cans.

In the food canning industry it is common for filled cans to be passed through sterilizing units such as hydrostatic sterilizing units in order to sterilize the contents of the can. When the cans have passed through the serialization process a considerable quantity of water droplets remains on the surfaces of the cans. Furthermore, seams in the cans may sometimes be prone to leakage temporarily after serialization. The presence of water is therefore undesirable because microorganisms can proliferate in the water thereby presenting a risk of contamination of the cans by passage of the microorganisms through leaky seams.

It has been proposed to remove such surface liquid from the cylindrical surfaces of the cans by rolling the cans past an air knife which blows a jet of air at the surfaces of the cans. However, this has not been found generally acceptable, as it is difficult to clean the entire cylindrical surface from water droplets without using a plurality of such air knives. Furthermore, if the air knives are inclined to the rolling axes of the can the water droplets are still not removed sufficiently, since they tend to collect towards the end of the can under the rim or seam adjoining the cylindrical surface.

A second method to remove such surface liquid has been proposed which comprises the use of a heated bed drier. Cans are rolled about their longitudinal axes across a steam heated surface, generally at a temperature in the region of 127°-130° C. The surface is covered with an absorbent cloth on which moisture collects. The temperature of the cloth is thought high enough to evaporate the moisture rapidly, thereby preventing growth of microorganisms. Compressed air may be blown across both ends of the can prior to heating so as to remove water in the can countersinks.

A third method to remove surface liquid has been proposed which comprises the use of internal drying systems. Cans mounted on the carrier bars of the sterilizer can be dried before being discharged. After cooling, the cans are sprayed with a surfactant/steam mixture and then travel down a drying leg through which a counter current of air is drawn. This method suffers from a number of disadvantages. Firstly, the method results in a delay in the processing of the cans as it takes at least ten minutes for the cans to be dried in this way. Secondly, this method is very expensive. It is commonly performed in a drying tower which has to be maintained at a high temperature thereby resulting in a considerable expenditure of energy.

Each of these prior art methods is described in "Hygienic Design of Post Process Can Handling Equipment" (Technical Manual No 8, published by The Campden Food Preservation Research Association, Chipping Campden, Gloucestershire, GL55 6LD, England).

The present invention provides apparatus for removing surface liquid from an elongate article, which apparatus comprises means for applying the jet of gas at an acute angle to the surface of the elongate article, means for causing relative motion between the article and the jet, and suction means provided downstream as considered in the direction of the jet for applying suction to a region of the surface of the elongate article whereby surface liquid is removed therefrom.

This apparatus avoids the need to use a plurality of air-knives and, when applied to cans, is capable of removing unwanted liquid from the entire surface of the cans to a level acceptable for the purpose of reducing risk of contamination.

The invention also extends to apparatus for removing surface liquid from the peripheral surfaces of a succession of elongate articles, such as cylindrical cans, in which means are provided for feeding the articles in succession through the apparatus.

Preferably, the acute angle at which the jet of gas is applied to the surface of the elongate article is in the range 65° to 75°, more preferably about 70°. Typically, the means for applying the jet of gas comprises an air knife. Preferably, the air knife has an annular slot up to 2 mm wide through which air is blown onto the surface of the elongate article. The suction means may be spaced about 5 mm from the jet and preferably comprises a suction hood which may include an annular suction opening. This opening is typically inclined at an angle of 80° to the surface of the elongate article.

In operation, where the elongate article is a can, the gas may be supplied via a plenum chamber preferably at a pressure not in excess 50 psi. Although higher pressures (say 70-85 psi) may be used, the combination of the jet of gas and suction means permits lower pressures to be used thereby reducing further the cost of operating the apparatus. Cans are passed through the apparatus by any conventional means such as in "sticks" of up to 17 cans which may be pushed through at a controlled speed by continuous dog chain. Surface liquid is blown from the cans by the jet of gas and may form a standing wave of liquid which is removed from the surface of the can by the suction means.

By the expression "surface liquid" it is intended to include not only droplets of water or other liquid, but also any solid particles which may be entrained in the liquid.

An embodiment of the invention will now be described, by way of example only, with reference to the accompanying single figure of drawings, which shows a side view, partly in section, of apparatus according to the invention.

The apparatus shown in the figure comprises essentially two elements, namely, an air knife device 10 and a suction device 12.

The air knife device has a cylindrical body 14 having on the right a flange 16. A knife housing 18 is secured to the flange 16, sealing against the cylindrical body 14 through an O-ring 20.

To the left of the body 14 and the housing 18 these parts form a narrow annular gap 19 to which air under pressure can be applied through an opening 24 at the top of the housing.

The internal diameter of the cylindrical body 14 is of the order of 80 mm, and is adapted to receive a succession of cans C, the clearance with each can being about 2 mm all around its periphery.

The cans C are fed into the air knife from the left hand side, so that a component of the air jet is facing opposite to the direction of movement of the cans.

The suction device 12 is somewhat similar to the air knife although a mirror image of it. The device consists of a cylindrical body 26 formed with a flange 28, with a suction housing 30 being secured to the flange. The right hand side of the housing forms with the cylindrical body 26 and annular space 31 through which air is drawn under suction through an opening 32 towards the bottom of the housing 30. The annular space 31 is inclined at an angle of 80° to the surface of the article.

The width of the air jet gap 19 is preferably 0.25 mm and the air pressure preferably from 3 to 15 psi. A peak air flow rate of 27 l/s is preferred.

In operation a succession of cans or "sticks" of cans are fed at speeds of up to around 2 m/sec through the apparatus. The maximum can throughput rate is typically 450 cans per minute. The droplets of water thus collect to the left of the air jet to form a standing wave 34 around the can. The geometry of the air knife and the suction hood is so arranged that the standing wave occurs in the vicinity of the suction space 31 so that water is continually sucked off from the standing wave.

By having the inclination of the air jet at an angle of about 70° from the surface or axes of the cans, the air resistance experienced by the cans is reduced, thus reducing the energy requirements of the apparatus. Furthermore since there may be a series of circular grooves formed in the can, such as shown at 36, the air jet is capable of penetrating such grooves to remove the water from them.

At the bottom of the air knife and the suction device are formed a pair of skids on which the cans rest so that they are held centrally within the air knife.

In normal operation groups or sticks of cans of about 17 in number may be fed through the air knife. In order to avoid the initial high force caused by the air knife on the first can entering the air knife, it may be arranged that the last can of each stick is always left in the air knife until it is pushed through by the first can of the next stick.

It will be apparent that the apparatus described is capable of removing substantially all the surface water from the cylindrical surfaces of the cans, even around the rims or seams of the cans.

By way of example, Table 1 shows the effect of varying air-knife angle and application of suction on the level of moisture remaining on the body of the cans. The results were obtained using 16 oz cans. Typical moisture levels on cans emerging from the sterilizer are about 750 mg. Although increasing can velocity reduces drying performance, use of a 70° knife and suction hood give good performance typified by moisture level of less than 30 mg at can velocities of 1.8 m/s.

TABLE 1

| Air-Knife angle | Suction Hood | Can Speed | Body moisture level |
|---|---|---|---|
| 45° | – | 1.8 m/s | 32.3 mg |
| 70° | – | 1.8 m/s | 29.9 mg |
| 70° | + | 1.8 m/s | 22.4 mg |
| 70° | + | 0.85 m/s | 11.4 mg |

I claim:

1. A method of removing surface liquid from a container, which comprises applying a jet of gas as an annulus to circumscribe the surface of the container at an acute angle thereto, causing relative motion between the container and jet, and applying suction downstream in the direction of flow from the jet to a region of the surface of the container whereby surface liquid is removed therefrom.

2. A method as claim in claim 1, wherein the acute angle is in the range 65° to 75°.

3. A method as claimed in claim 2, wherein the acute angle is about 70°.

4. A method as claimed in claim 1, wherein the gas pressure does not exceed 50 psi.

5. Apparatus for removing surface liquid from a container, which comprises an air knife having an annular slot to circumscribe the surface of the container for applying a jet of gas at an acute angle thereto, means for causing relative motion between the container and the jet, and an orifice provided upstream in the direction of movement of the containers from the jet for applying suction to a region of the surface of the container whereby surface liquid is removed therefrom, the orifice spaced about 5 mm from the jet.

6. Apparatus as claimed in claim 5, wherein the acute angle is in the range 65° to 75°.

7. A method of removing surface liquid from an elongate article, which comprises applying a jet of gas as an annulus at an acute angle to the surface of the elongate article, causing relative motion between the article and the jet, and applying suction upstream from the jet in the direction of movement of the elongate articles relative to the jet to a region of the surface of the elongate article whereby surface liquid is removed therefrom, the suction applied about 5 mm from the jet.

8. A method as claimed in claim 7, wherein the acute angle is in the range 65° to 75°.

9. Apparatus as claimed in claim 5, wherein the acute angle is about 70°.

10. Apparatus as claimed in claim 5, wherein the annular slot is up to 2 mm wide.

11. Apparatus as claimed in claim 5, wherein the orifice forms part of a suction hood.

* * * * *